US009048544B2

(12) United States Patent
Georgiadis et al.

(10) Patent No.: US 9,048,544 B2
(45) Date of Patent: Jun. 2, 2015

(54) REFLECTARRAY ANTENNA SYSTEM

(75) Inventors: Apostolos Georgiadis, Castelldefels (ES); Ana Collado Garrido, Castelldefels (ES)

(73) Assignee: FUNDACIO CENTRE TECHNOLOGIC DE TELECOMUNICACIONS DE CATALUNYA (ES)

( * ) Notice: Subject to any disclaimer, the term of this patent is extended or adjusted under 35 U.S.C. 154(b) by 651 days.

(21) Appl. No.: 13/393,678

(22) PCT Filed: Sep. 2, 2009

(86) PCT No.: PCT/EP2009/061316
§ 371 (c)(1),
(2), (4) Date: Mar. 1, 2012

(87) PCT Pub. No.: WO2011/026513
PCT Pub. Date: Mar. 10, 2011

(65) Prior Publication Data

US 2012/0162010 A1 Jun. 28, 2012

(30) Foreign Application Priority Data

Sep. 1, 2009 (ES) ..... 200930641

(51) Int. Cl.
*H01Q 3/02* (2006.01)
*H01Q 3/42* (2006.01)
(Continued)

(52) U.S. Cl.
CPC ..... *H01Q 3/42* (2013.01); *E02D 29/14* (2013.01); *H01Q 3/46* (2013.01)

(58) Field of Classification Search
CPC ..... H01Q 3/02; H01Q 3/12; H01Q 3/00
USPC ..... 342/374, 371, 368, 370, 369, 376
See application file for complete search history.

(56) References Cited

U.S. PATENT DOCUMENTS 3,653,046 A * 3/1972 Glance ..... 342/371
4,394,660 A * 7/1983 Cohen ..... 342/369
(Continued)

FOREIGN PATENT DOCUMENTS

DE 3813858 A1 12/1988

OTHER PUBLICATIONS

Hoeye, Injection-Locked Harmonic Self-Oscillating Mixer for Variable Phase-Shifter Applicaitons in Active Microstrip Phased Antenan Arrays, 2005, IEEE.*
(Continued)

*Primary Examiner* — Harry Liu
(74) *Attorney, Agent, or Firm* — Cantor Colburn LLP

(57) ABSTRACT

The reflectarray includes a plurality of cells integrated in a PCB and externally illuminated by an input signal from a feeding source at a frequency $f_i$, and an output signal is reflected, where each cell of the reflectarray is an AIA formed by a passive radiating element connected to an active circuit, which can be either an oscillator, or a push-push oscillator or a SOM, where the passive radiating circuit is placed on a reflective surface forming a side of the reflectarray and the active circuit is placed on the reverse side, the active circuit producing an output signal with a frequency related to the input frequency $f_i$ and the oscillation frequency $f_{osc}$ of said active circuit. This phase relationship is determined by an output phase variation, which is controlled by electronic means integrated in the reflectarray system, which allows an output phase variation interval even higher than 180°.

14 Claims, 6 Drawing Sheets

(51) Int. Cl.
*E02D 29/14* (2006.01)
*H01Q 3/46* (2006.01)

(56) References Cited

U.S. PATENT DOCUMENTS

| | | | | |
|---|---|---|---|---|
| 6,473,362 | B1 | 10/2002 | Gabbay | |
| 7,030,824 | B1 * | 4/2006 | Taft et al. | 343/767 |
| 7,109,918 | B1 * | 9/2006 | Meadows et al. | 342/368 |
| 7,791,552 | B1 * | 9/2010 | Romanofsky | 343/754 |
| 7,868,829 | B1 * | 1/2011 | Colburn et al. | 343/700 MS |
| 2008/0278369 | A1 * | 11/2008 | Milano | 342/175 |
| 2010/0214171 | A1 * | 8/2010 | Quan et al. | 342/374 |

OTHER PUBLICATIONS

Liao, Phase-Shifterless Beam-Scanning Using Coupled-Oscillators: Theory and Experiment, 1992, IEEE.*

Boccia, A Microstrip Patch Antenna Oscillator for Reflectarray Application, 2004, IEEE.*

Eduardo Carrasco, Demonstration of a Shaped Beam Reflectarray Using Aperture-Coupled Delay Lines for LMDS Central Station Antenna, IEEE Transactions on Antennas and Propagation, vol. 56, No. 10, Oct. 2008, pp. 3103-3111.

D.G. Berry, "The Reflectarray Antenna", IEEE Transactions on Antennas and Propagation, Nov. 1963, pp. 645-651.

Luigi Boccia, "A Microstrip Patch Antenna Oscillator for Reflectarray Applications", 2004, IEEE, pp. 3927-3939.

E. Carrasco, "Aperture-coupled reflectarray element with wide range of phase delay", Electronics Letters Jun. 18, 2006 vol. 42 No. 12.

Ana Collado, "Application of Bifurcation Control to Practical Circuit Design", IEEE Transactions on Microwave Theory and Techniques, vol. 53, No. 9, Sep. 2005, pp. 2777-2788.

Ana Collado, "Nonlinear Mode Analysis and Optimization of a Triple-Push Oscillator", IEEE Microwave and Wireless Componets Letters. vol. 18, No. 8, Aug. 2008, pp. 545-547.

Ana Collado, "A Reduced Order Model for the Nonlinear Analysis of Coupled Oscillator Arrays with External Injection Locking", Antennas and Propagation Society International Symposium 2009. Jun. 1, 2009 pp. 1-4, XP031495450.

Minoru Sanagi, "Beam Control in Unilaterally Coupled Active Antenna with Self-Oscillating Harmonic Mixers", IEICE Trans. Electron., vol. E88-C, No. 7, Jul. 2005, pp. 1375-1381.

Apostolos Georgiadis, "Pattern Nulling in Coupled Oscillator Antenna Arrays", IEEE Transactions on Antennas and Propagation, vol. 55, No. 5, May 2007, pp. 1267-1274.

Apostolos Georgiadis, "Nonlinear analysis of a reflectarray cell based on a voltage-controlled oscillator", Centre Tecnologic de Telecomunicacions de Catalunya, Castelldefels 08860, Spain, 2008, IEEE.

Ted Heath, "Simultaneous Beam Steering and Null Formation With Coupled, Nonlinear Oscillator Arrays", IEEE Transactions on Antennas and Propagation, vol. 53, No. 6, Jun. 2005. pp. 2031-2035.

S. Ver Hoeye, "Injection-Locked Harmonic Self-Oscillation Mixer for Varible Phase Shifter Applications in Active Microstrip Phased Antenna Arrays", Signal and Communications Theory Area, Department of Electrical Engineering, University of Oviedo, pp. 205-208.

John Huang, "A Ka-Band Microstrip Reflectarray with Elements Having Variable Rotation Angles", IEEE Transactions on Antennas and Propagation, vol. 46, No. 5, May 1998, pp. 650-656.

Kaneyuri Kurorawa, "Injection Locking of Microwave Solid-State Oscillators", Proceedings of the IEEE, vol. 61, No. 10, Oct. 1973, pp. 1386-1412.

P.Liao, "A New Shifterless Beam-Scanning Technique Using Arrays of Coupled Oscillators", IEE Transaction on Microwave Theory and Techniques, vol. 41, No. 10, Oct. 1993, pp. 1810-1815.

P. Liao, "Phase-Shifterless Beam-Scanning Using Couple-Oscillator: Theory and Experiment", Department of Electrical Engineering, University of California, IEER Antennas Propagation Society International Symposium, 1993 pp. 668-671, XP000419981.

Jenshan Lin, "Active Integrated Antennas", IEEE. Transactions on Microwave Theory and Techniques. vol. 12. No. 12. Dec. 1994, pp. 2186-2194.

Ryan Y. Miyamoto, "Retrodirective Arrays for Wireless Comminucations", IEEE Microwave Magazine, Mar. 2002, pp. 71-19.

Carl W. Pobanz, "A Reflection Mode Self-Oscillating GaAs Fet Mixer", 1994 Asia Pacific Microwave Conference, pp. 131-133.

David M. Pozar, "Design of Millimeter Wave Microstrip Reflectarrays", IEEE Transactions on Antennas and Propagation, vol. 45, No. 2, Feb. 1997, pp. 287-296.

Minoru Sanagi, "Active Phased Array Antenna Radiating Second Harmonic Output Wave", Electronics and Communications in Japan, Part 2, vol. 89, No. 4, 2006, pp. 39-50.

Grant S. Shiroma, "A 16-Element Two-Dimensional Active Self-Steering Array Using Self-Oscillating Mixers", IEEE Transactions on Microwave Theory and Techniques, vol. 51, No. 12, Dec. 2003, pp. 2476-2482.

Karl D. Stephan; "Inter-Injection-Locked Oscillators for Power Combining and Phased Arrays", IEEE Transactions on Microwave Theory and Techniques, vol. MTT-34, No. 10, Oct. 1986.

Hai Xiao, "Push-push oscillator with simplified circuit structure", Electronics Letters Nov. 21, 2002 vol. 38 No. 24, pp. 1545-1547.

Apostolos Georgiadia, "Patents on Reconfigureable Reflectarray Antennas", Recent Patents on Electrical Engineering 2009, vol. 2, No. 1, pp. 1-7, XP-002557814.

R.A.York, "Nonlinear Analysis of Phase Relationships in Quasi-Optical Oscillator Arrays", IEE Transactions on Microwave Theory and Techniques, vol. 41, No. 10, Oct. 1993, pp. 1799-1809.

* cited by examiner

REFLECTARRAY ANTENNA SYSTEM

FIELD OF THE INVENTION

The present invention relates to the field of reflective array (reflectarray) antennas, more particularly, deals with a reconfigurable reflectarray based on active integrated antennas (AIAs) and provides the capability of electronically controlling the phase of its reflected wave.

STATE OF THE ART

The principle of operation of a reflectarray antenna consists of designing a directive beam by properly synthesizing the reflected wave phase from an array of antenna radiators forming a reflecting surface illuminated by a feed antenna ["The reflectarray antenna", D. Berry, R. Malech, and W. Kennedy, IEEE Transactions on Antennas and Propagation, vol. 11, no. 6, pp, 645-651, 1963]. In a parabolic reflector topology, a planar wave form is created when the feed antenna is placed in its focal point as all the propagating paths of the illuminating waves reaching the reflecting surface are equal. This does not hold in the case of the planar, or (in general) conformal, reflecting surface used in the reflectarray configuration. Careful design of the reflecting wave from each element is thus required, in order to compensate for the differences in the phase paths.

In order to produce the required reflection phase values for fixed main beam direction, different methods have been proposed in the literature. These include, for example, the use of printed elements of different size, or using identical elements with attached stubs of variable length. Both techniques essentially lead to controlling the reflection phase by modifying the resonance frequency of the radiating element ["Design of millimeter wave microstrip reflectarrays" D. Pozar, S. Targonski and H. Syrigos, IEEE Transactions on Antennas and Propagation, vol. 45, no. 2, pp. 287-296, February 1997].

The demand for reconfigurable reflectarray antennas has increased in the last years due to the fact that they combine attractive properties stemming from both reflector antennas (such as a low loss radiation input of the feed network) and array antennas (such as low cost, and electronic beam scanning).

Additionally reflectarrays can be adapted to the shape of their mounting surface, which makes them more suitable than reflector antennas for many applications.

One of the main applications of reflectarrays is in satellite communications. Space application requirements aim for high performance, low volume and cost. Reconfigurable reflectarrays have a natural application in failure recovery situations where a spare antenna can be reconfigured to substitute another one that is malfunctioning. Space applications require accurate alignment between the satellite and the terminal due to the relative movement between them. Reconfigurable reflectarrays allow for easy realignment of these systems. Moreover, reflectarrays with beam scanning capabilities are considered for use in ground satellite terminals. Recently, reflectarray antennas have also been proposed for Local Multipoint Distribution Network (LMDS) applications ["Demonstration of a Shaped Beam Reflectarray Using Aperture-Coupled Delay Lines for LMDS Central Station Antenna", E. Carrasco, IEEE Transactions on Antennas and Propagation, vol. 56, no. 10, pp. 3103-3111, October 2008].

Work remains to be done towards the implementation of architectures that exhibit reconfigurable properties such as electronic beam scanning. Alternative techniques to achieve reconfigurable features have been proposed using: diode mixers, varactor diodes, ferroelectric thin films, liquid crystal, photonically controlled semiconductor and Micro-Electro-Mechanical-Systems (MEMS). Another approach to control the beam direction is mechanically introducing rotations in the patch antennas that form the array ["A Ka-band microstrip reflectarray with elements having variable rotation angles", J. Huang and R. Pogorzelski, IEEE Transactions on Antennas and Propagation, vol. 46, no. 5, pp. 650-656, May 1998.].

Nonlinear antenna arrays based on active integrated antennas (AIAs) are known and have several attractive properties such as compact size, low cost, and light weight. An AIA consists of a passive radiating element and an active circuit, integrated in the same substrate ["Active integrated antennas", J. Lin and T. Itoh, IEEE Transactions on Microwave Theory and Techniques, vol. 42, no. 12, pp. 2186-2194, December 1994].

In oscillator AIAs, a radiating element, such as a patch antenna, acts both as a load and a resonator to an active element properly biased to provide a negative resistance necessary to produce an oscillation. In self-oscillating mixer (SOM) AIAs the active device is biased so that it operates as an oscillator and a mixer at the same time. Oscillator and SOM AIAs coupled to each other form AIA arrays which have been used in power combining, and phased arrays.

Push-push oscillators are also known ["Push-push oscillator with simplified circuit structure" X. Hai, T. Tanaka and M. Aikawa, Electronics Letters, vol. 38, no. 24, pp. 1545-1547, 2002]. A Push-push oscillator consists of an array of two oscillators coupled so that they oscillate out of phase (differential mode). If one selects the output port of the oscillator appropriately, the fundamental component is cancelled out, and the second harmonic components add up. As a result such topologies are commonly used for high frequency generation.

Also it is known that when an oscillator is injection locked to an external source and synchronization occurs, a fixed phase relationship is established between the external source phase and the oscillator phase. This phase relationship is directly related to the difference between the external source frequency and the oscillator free-running frequency. If the oscillator has a control parameter that allows changing its free-running frequency (such as the DC bias of a varactor diode), the phase relationship between the injection source and the oscillator can also be varied. In an array configuration, the relative phases of the radiated outputs of the AIAs ultimately define the main beam direction of the array and, generally, the shape of the radiation pattern.

The theory of injection-locked oscillators ["Injection locking of microwave solid-state oscillators" K. Kurokawa, Proceedings of the IEEE, vol. 61, no. 10, pp. 1386-1410, October 1973], shows that when injecting the oscillator at its fundamental frequency and observing the output phase at the $N^{th}$ harmonic, the output phase can be varied by approximately N*180° (stable range) relative to the injection signal phase ["Active phased array antenna radiating second harmonic output wave", M. Sanagi et al., Electronics and Communications in Japan (Part II: Electronics), vol. 89, no. 4, pp. 39-50, March 2006].

An oscillator AIA forming the basic cell of a reflectarray and radiating at the fundamental harmonic is proposed in "A Microstrip patch antenna oscillator for reflectarray application" by L. Boccia, G. Amendola, and G. di Massa, Proc. IEEE AP-S International Symposium 2004, pp. 3927-3930, 2004. Once the AIA oscillator is synchronized to the illuminating source of the reflectarray a fixed phase difference is established between them. The phase difference between the oscillator and the injection source can be continuously set by varying the free-running frequency of the oscillator by means of a control parameter. But note that the oscillator AIA proposed by L. Boccia et al. is affected by the stability margin associated with synchronized oscillators at the fundamental frequency, which limits the maximum phase scanning interval to 180 deg. This restriction is not taken into account by L. Boccia et al. but is shown in "Nonlinear analysis of a reflectarray cell based on a voltage-controlled oscillator", by A. Georgiadis and A. Collado, IEEE AP-S International Symposium, San Diego, July 2008. Moreover, in the design example of Boccia et al. the radiator and the oscillating circuit are at the same plane. Such a topology may lead to problems when designing a reflectarray due to available space limitation, in order to maintain a typical 0.5-0.65 free space wavelengths distance among the radiating elements and accommodate the active circuitry and the bias lines.

The application of coupled oscillator arrays in power combining and phased array systems was demonstrated ["Inter-injection locked oscillators for power combining and phased arrays," K. D. Stephan, IEEE Trans. Microwave & Theory Tech, vol. 34, no. 10, pp. 1017-1025, October 1986]. In addition, ["A new phase-shifterless beam-scanning technique using arrays of coupled oscillators," P. Liao, and R. A. York, IEEE Trans. Microwave & Theory Tech, vol. 41, no. 10, pp. 1810-1815, October 1993] showed that constant phase-shift distributions among coupled oscillator array elements can be generated by only tuning the free-running frequencies of the edge elements of the array. Using this methodology the synchronized frequency of the array varies with the detuning of the two edge elements. If one desires to keep the array frequency fixed, one may control the free-running frequencies of more elements. A design methodology for introducing nulls to the radiation pattern in addition to scanning the main beam was demonstrated ["Simultaneous beam steering and formation with coupled, nonlinear oscillator arrays," T. Heath, IEEE Transactions on Antennas and Propagation, vol. 53, no. 6, pp. 2031-2035, June 2005 and "Pattern Nulling in Coupled Oscillator Antenna Arrays," A. Georgiadis, A. Collado, and A. Suarez, IEEE Transactions on Antennas and Propagation, vol. 55, no. 5, pp. 1267-1274, May 2007]. These architectures are used in transmit applications. Furthermore nearest neighbour coupling among the oscillators is considered, and the input signal or feed structure to the array is not specified. In power combining systems the oscillators are used to radiate RF power signals that do not contain any information.

The use of coupled oscillator arrays in beam-forming and beam steering is proposed in U.S. Pat. Nos. 7,109,918 and 6,473,362. In U.S. Pat. No. 7,109,918 the coupled oscillator array is a free-running system. Beam steering is proposed by detuning the free-running frequencies of only the edge array elements. As noted in the previous paragraph this is possible by allowing the synchronized oscillation frequency to take different values for every constant phase shift distribution (i.e. beam steering angle). Additionally, beam-forming is proposed by detuning all oscillator elements. It should be noted that by allowing the frequency of all elements to be tuned one may also fix the array frequency to a constant value. The described structure may nevertheless lead to problems due to frequency drift and phase noise limitations.

Finally, U.S. Pat. No. 6,473,362 deals with another application of coupled oscillator arrays, namely a receive narrowband beam-former where the dynamical properties of such arrays are used to separate a desired receive signal from undesired interferers.

The application of coupled SOM arrays for retro-directive applications was demonstrated ["A 16-element two-dimensional active self-steering array using self-oscillating mixers," G. S. Shiroma, R. Y. Miyamoto, W. A. Shiroma, IEEE Transactions on Microwave Theory and Techniques, vol. 51, no. 12, pp. 2476-2482, December 2003]. In this publication a coupled SOM array is used to steer the main beam to the direction of the incoming wave. In this sense it differs from a reflectarray configuration because it relates to a fixed beam array as there is no dynamic control of the output beam.

The capability of beam-forming using a down-converter array of coupled SOMs was demonstrated ["Beam Control in Unilaterally Coupled Active Antennas with Self-Oscillating Harmonic Mixers," M. Sanagi, J. Fujiwara, K. Fujimori, and S. Nogi, IEICE Transactions on Electronics, vol. E88-C, no. 7, pp. 1375-1381, July 2005]. Also, this configuration differs from a reflectarray configuration as the array is used as a receiver and not to re-transmit the incoming signal. In addition, unilateral, nearest neighbour coupling is employed.

Finally, it is known ["Nonlinear analysis of phase relationships in quasi-optical oscillator arrays," R. A. York, IEEE Transactions on Microwave Theory and Techniques, vol. 41, no. 10, pp. 1799-1809, October 1993] that for a given linear or planar array of N synchronized oscillator elements with weak nearest neighbour coupling, there exist up to $2^{N-1}$ different possible phase distributions or modes, one of which is stable. If there exists an external injection source applied to one of the array elements, then the number of different modes becomes $2^N$, as there exist 2 possible phase difference values (with approximately 180° difference among them) between the injection signal and the oscillator to which the injection signal is applied.

In a different scenario, let one consider a synchronized linear or planar array of N elements with weak nearest neighbour coupling, and let one select one of the $2^{N-1}$ modes which corresponds to a specific phase distribution among the elements. One may select, for example, the mode that corresponds to a constant phase distribution along the array. If one further considers an external injection source that is applied to each of the N oscillators, there exist $2^N$ modes corresponding to each of the 2 phase combinations between every pair consisting of the injection source and each of the oscillators of the array. As a result there exist $2^N$ modes corresponding to a specific phase distribution among the N array elements.

SUMMARY OF THE INVENTION

In order to overcome the limitations in the prior art described above, the present invention takes advantage of the synchronization properties of injection-locked oscillators to implement reconfigurable reflectarray cells that introduce beam steering (reconfigurable) capabilities to a reflectarray antenna.

All the implementations of a reconfigurable reflectarray proposed here achieve control of the beam direction by electronic means, thus in an easier way compared to conventionally used mechanical control. In addition, some of the proposed reconfigurable reflectarray configurations reach a theoretical maximum phase scanning interval (the variation of the reflected phase) higher than 180 degrees. Also, the invention allows a considerable decrease in the setting time of the reflectarray system for beam forming and beam scanning.

Three possible architectures for the proposed reflectarray are described here, using active integrated antennas (AIAs), two of them based on oscillator AIAs and one on SOM AIA, as follows:

1) A first implementation of the reconfigurable reflectarray is based on injection locked oscillator arrays.

More precisely, the reflectarray antenna system comprises a plurality of cells, each cell being an active integrated antenna (AIA), which is formed by a passive radiating circuit connected to an oscillator circuit. The reflectarray system has an input (feeding) signal, which is introduced to the cells by means of a feeding network, and an output (reflected) signal. The topology of the feeding network can be considered as a star coupling network wherein each array cell is independently coupled to the synchronizing source. At the same time, each of the array cells is coupled to its neighbouring cells due to radiation coupling as well as due to a coupling network that may be, but is not limited to, a resistive loaded transmission line network.

The reconfigurable reflectarray has two sides: One side with a reflective surface on which the passive radiating circuit is placed. As an example one may use aperture coupled patch antennas as radiating elements. The other side is where the oscillator circuits and the coupling network are located on.

The array of AIAs is externally synchronized by a feeding source (e.g., a horn antenna feed) radiating at a fundamental frequency $f_0$, close to the fundamental frequency of the oscillator circuits. The oscillator elements synchronize with each other and with the feeding source. In this invention, the reflected wave frequency corresponds to the fundamental frequency $f_0$ of the oscillators.

When synchronizing the oscillators at the fundamental frequency and then radiating also this fundamental frequency $f_0$, a maximum theoretical output (reflected) phase variation of 180° can be obtained at the oscillator output. Due to the fact that the external feeding signal simultaneously injects all array elements, the maximum output phase variation is reduced. Specifically it depends on the number of elements of the array. If one considers a linear array of oscillator elements that are not coupled to each other and that each one is synchronized to a common feed signal, the maximum phase tuning among the oscillator elements that can be achieved is $360°/(N-1)$, $N \geq 3$, where N is the number of the oscillators in the array. The existence of coupling between the oscillator elements permits that the maximum tuning phase extends beyond the $360°/(N-1)$, $N \geq 3$ limit, however always bound by the absolute maximum of 180°.

The present invention proposes the design of an optimum coupling network that maximizes the tuning range beyond the aforementioned value and closer to the absolute maximum. There exists an optimum coupling strength that depends on the injection signal power, which maximizes the stable phase tuning range.

In addition, use of a number of different operating modes from the total of $2^N$ modes that correspond to a specific phase distribution along the array elements is proposed to achieve the theoretical limit of 180° independently of the number of oscillators in the array. Assuming the input signal injects all oscillators the maximum achievable reflected wave phase variation depends on the number of elements that form the reflectarray. As the number of elements increases, the output phase variation decreases. This problem can be mitigated by taking into account the fact that the proposed reflectarray based on AIA with coupled oscillators presents several mathematical solutions depending on the input signal phase applied at each element.

Given an array of N identical coupled oscillator elements with a constant (fixed) phase shift distribution, there exist up to $2^N$ combinations (modes) of the input feeding signal phase at each oscillator. These modes correspond to the $2^N$ combinations of $\phi_i$ and $\phi_i+180$, with $\phi_i$ and $\phi_i+180$ being the two possible input signal phase values at element i, that lead to a constant (fixed) phase shift solution of the system. Depending on the phase shift distribution among the oscillator elements, a different mode is stable, allowing one to obtain a tuning range of 180°. This implies that more than one combination of input signal phases has to be considered.

The proposed architecture requires the capability of changing the input signal phase at each of the elements from $\phi_i$ to $\phi_i+180$. Each of the reflectarray cells has two phase operation states: one where the input signal arrives with a phase $\phi_i$ and one where the input signal arrives with a phase $\phi_i+180$. These phase states are achieved implementing two possible input paths that connect the radiating element with the oscillator input. The two paths have a difference in their phase delays of 180°. By means of a switching device, one can chose the phase delay with which the input signal arrives to the oscillators. Furthermore this architecture requires that a different port is used for the input (feed) and output (reflected) signals. This can be achieved, for example, by designing a dual polarization antenna element and selecting different polarizations for the input and output signals.

In a realistic implementation the angle of arrival of the feeding signal to each oscillator depends on their relative position in the array. This means the input signal phase $\phi_i$ is not the same for all the elements in the array, and consequently the oscillator output phase tuning range is not the same for all the oscillators. This in effect may further reduce the maximum achievable reflected beam scanning range for the array. The input of each oscillator element can be designed so that it compensates the phase variations of the input feed signal.

An initial tuning is performed to compensate for the injection (feed) signal phase differences between each oscillator, leading to a fixed reflection beam direction. Tuning of the reflection phase is achieved by varying the length of a transmission line stub (the tuning stub). The length of this line is different for each oscillator and directly depends on the oscillator position in the array. One advantage of this technique is the ability to place the radiating circuit and the phase tuning stub on different layers, thus allowing for more flexibility in the layout of the antenna.

A phase tuning technique for the design of fixed beam reflectarrays, but not for reconfigurable reflectarrary as the present invention deals with, is described in ["Aperture-coupled reflectarray element with wide range of phase delay", E. Carrasco, M. Barba, and J. A. Encinar, Electronics Letters, vol. 42, no. 12, pp. 667-668, June 2006], where the radiating element consists of a microstrip patch antenna aperture coupled to a microstrip line stub.

Once this initial tuning or compensation is introduced in the reconfigurable reflectarrary operation, the output phase ranges in all the oscillators become the same. The reflected wave beam direction can then be modified by changing the output phase distribution among the oscillator elements. The proposed reconfigurable reflectarray comprises electronic means for the output phase variation. This output phase can be varied by individually changing the free-running frequency of the oscillator elements by means of a control parameter (e.g. a varactor voltage), in a easier way than the traditional method by mechanical means.

2) A second implementation of the reconfigurable reflectarray is described, constituting an extension of the first implementation. The additional advantageous feature of this second architecture is that it provides for extended reflection phase tuning range of 360 deg.

The array of AIA cells is externally synchronized by a feeding source (e.g., a feed horn) at a fundamental frequency $f_0$ and the extension in the scanning range is achieved by radiating the second harmonic component $2f_o$ of the oscillators. Utilizing the second harmonic signals at the output, while the oscillator elements are synchronized at the first harmonic, the attainable phase tuning range is essentially doubled. Optimizing the coupling among the oscillator elements and utilizing the second harmonic signal at the output, the maximum phase tuning range extends from a minimum 2*360°/(N−1), N≥3 limit, to a maximum of 360°. As in the previous topology the maximum theoretical limit of 360° can be achieved by switching between different operating modes.

The oscillator elements in this second implementation are push-push oscillators. The radiating elements placed on one (the reflecting surface) of the two sides of the reflectarray can be aperture coupled patch antennas. On the other (the reverse) side of the reflectarray, the push-push oscillator circuits are located. In this implementation the reflected wave frequency corresponds to the second harmonic component of the push-push oscillators $2f_o$.

The oscillator circuit having a push-push oscillator configuration comprises a first oscillator and a second oscillator coupled through a coupling network (e.g., a lumped element of meta-material), a ground plane and a phase shifting device (e.g., a varactor diode) which controls the variable free-running frequency $f_0$ of oscillation. The free-running frequency of one of the oscillators of the pair (the second oscillator) is fixed in order to maintain a simple control. This means that, by choosing a fixed free-running frequency in one of the two oscillators in the push-push configuration, only the free-running frequency of the other oscillator (the first oscillator) needs to be modified in order to vary the combined output phase of the reflected signal.

The proposed core oscillator circuit based on a push-push configuration, formed by the pair of oscillators oscillating at $f_o$, avoids radiating the first harmonic at said $f_o$. In this push-push oscillator configuration the two oscillators are coupled to have a phase difference between them of 180°, so that the signals at the first harmonic $f_o$ can be cancelled in the combined output and the signals at the second harmonic $2f_o$ are summed. Therefore, a push-push oscillator allows synchronization to the feeding source signal at $f_o$ and, at the same time, minimizes unwanted radiation of the reflected $f_o$ (electromagnetic interference) and maximizes the radiation at $2f_o$.

A feeding source (horn) illuminates the reflecting surface at a frequency similar to the fundamental frequency of the push-push oscillators $f_o$. The oscillator elements synchronize to the feeding source (star topology) and simultaneously they are coupled to their nearest neighbour cells by means of a coupling network, usually a resistively loaded transmission line, as well as radiation mutual coupling.

As in the previously proposed (first) implementation of a reconfigurable reflectarray, an initial tuning is necessary in order to equalize the input signal phase to all oscillator elements. Once the initial tuning has been introduced, the output phase variation in this push-push oscillator is obtained by keeping one of the oscillators free-running frequency fixed to a value while changing the other oscillator free-running frequency by means of a control parameter (e.g., a varactor voltage). Only one control element is required per oscillator element.

When synchronizing the push-push oscillators at the fundamental frequency $f_o$ and then radiating at the second harmonic $2f_o$, a maximum stable output phase variation of 360° can be obtained at the push-push oscillator output.

This is achieved by controlling the phase with which the input signal arrives to each of the elements, called phase state. Combining several phase states in the reflectarrays cells using a switching device in the same way as in the first implementation the maximum stable range of 360° can be obtained. The number of necessary phase states depends on the number of elements of the reflectarray. This configuration leads to a considerable increase in the beam scanning range in comparison with the previous implementation that allows only 180° stable output phase variation.

In order to inject at the fundamental frequency $f_o$ and radiate at $2f_o$, the radiating elements (antennas) have to have a double resonance at $f_o$ and $2f_o$. This requires a careful design of the antenna elements in order to get both resonances and achieve a compact design that keep the antenna elements spacing in the order of 0.5λ-0.65λ at the second harmonic component.

Finally, a variation that can be introduced in both proposed reconfigurable reflectarray topologies (the first and second implementations) is the use of regenerative oscillators ["Application of bifurcation control to practical circuit design," A. Collado, and A. Suarez, IEEE Transactions on Microwave Theory and Techniques, vol. 53, no. 9, pp. 2777-2788, September 2005]. A regenerative oscillator does not oscillate in the absence of injection signal. This way the reflectarray elements are inactive until the feeding horn begins transmitting. When the oscillators receive enough signal power from the feeding horn, they begin oscillating and the system works in its normal active mode. This regenerative reflectarray approach reduces the system power consumption considerably.

The two proposed implementations of reconfigurable reflectarrays can only be used for transmitting systems as a minimum injection power is required to synchronize all oscillator elements and this condition may not be met in receiving applications.

Additionally, both implementations are suitable for constant envelope modulations as the oscillator dynamics tend to eliminate amplitude variations.

3) A third implementation of the reconfigurable reflectarray is based on active antenna self-oscillating mixers (SOMs).

In contrast to the other two previous architectures, the SOM local oscillator is not injection locked to the input feeding signal. The illuminating signal $f_i$ is used as the input signal to the SOM that is mixed with the SOM fundamental or one of its harmonics ($N*f_{os}$, N=1, 2, or 3 typically) to produce an amplified output signal with frequency $f_o=Nf_{osc}\pm f_i$ with a desired phase. The output signal has a different frequency from the input signal, which means that the radiating element must have adequate bandwidth to accommodate both input and output signal frequencies. The SOM is designed to allow for tuning its oscillating frequency by electronic means, for example, a varactor diode.

The proposed reflectarray has two sides. One of them is formed by a reflecting surface where the radiating elements are placed. The received signal from the radiating elements is coupled (possibly by an aperture coupling mechanism) to the other side of the reflecting surface, where the SOM circuits are located. In this circuit layer, the individual SOMs are coupled to each other at the fundamental frequency of oscillation $f_o$ by means of coupling networks. Typically resistive loaded transmission line networks are used.

A similar array of coupled SOMs has been used in the aforementioned approach by Shiroma et al. ["A 16-element two-dimensional active self-steering array using self-oscillating mixers," G. S. Shiroma, R. Y. Miyamoto, W. A. Shiroma, IEEE Transactions on Microwave Theory and Techniques, vol. 51, no. 12, pp. 2476-2482, December 2003]. However in the work by Shiroma et. al. this structure was used for retro-directive systems applications, not for reflectarrays. Specifically the already existing approach used an oscillation frequency approximately twice the injection frequency $f_{os}\approx 2f_i$. By contrast, the architecture proposed in this invention uses instead $f_i=N*f_{os}+\Delta f$, with $\Delta f$ depending on the design and the radiator bandwidth. N is the order of the harmonic that is used in the mixing process.

In a retro-directive array employing the heterodyne mixing method as the approach by Shiroma et al. does, the input signal is multiplied with a local oscillator signal having twice the frequency of the input. As a result, a mixing product is produced that has the same frequency as the input signal and a phase that is equal to the negative of the input signal phase plus a constant. In fact the objective of the retro-directive architecture, unlike the aim of the present reflectarray architecture, is to precisely generate the negative of the input phase, something that requires multiplication with the local oscillator at twice the frequency of the input. This results in pointing the reflected beam towards the direction of the input signal.

On the contrary, in a reflectarray configuration, the objective is to generate a reflected beam towards a direction that is different from the input signal. For this reason, the oscillating frequency does not have to be twice the input signal frequency, and any harmonic maybe used.

Besides, in the proposed reflectarray, which has reconfigurable beam capabilities, the objective is to be able to dynamically change the direction of the reflected beam and the shape of the radiation pattern. As a result, the SOM elements need to have a frequency tuning capability, using electronic means, such as a varactor diode, for example. Depending on the harmonic that is involved in the mixing, a different tuning range of the reflected phase can be achieved. This is the major difference of the invention with respect to the retro-directive array architecture by Shiroma et al.: the fact that in the present reflectarray architecture the SOM have electronic means (some varactor diode typically) appropriately connected to the circuit for frequency tuning, which allows for dynamic electronic control of the output signal phase. As the SOMs form a coupled oscillator array, their relative phases can be set by tuning their free-running frequencies, thus leading to a reconfigurable beam reflectarray architecture.

It is necessary to lock the SOM array frequency to a common reference signal. However, due to the dynamical properties of the array one needs to provide the reference signal only at one or few injection points in the array, in contrast to typically phased array architectures where a more complicated local oscillator distribution network is required to be provided at each element. This fact is the main advantage of using a coupled SOM array.

An example of using a coupled SOM array for receiver phased array applications is in another aforementioned mentioned approach, the one by Sanagi et al. ["Beam Control in Unilaterally Coupled Active Antennas with Self-Oscillating Harmonic Mixers," M. Sanagi, J. Fujiwara, K. Fujimori, and S. Nogi, IEICE Transactions on Electronics, vol. E88-C, no. 7, pp. 1375-1381, July 2005]. However, the SOM array in the approach by Sanagi et al. is used for downconverting the input signal. Also, a different coupling mechanism is used.

In the above reference the frequency planning is such that the output of the array is at an IF frequency much lower than the RF input frequency, as the SOM is used as a downconverter mixer. By contrast, in the present invention, the frequency planning is such that the input and output frequencies do not take values that are very different. This is required because a single antenna is used at the input and output port, therefore it must have enough bandwidth (dual band design maybe required) to accommodate both frequencies.

Furthermore, in the referenced Sanagi's approach. unilateral coupling among the oscillators is used with the help of a 90 deg hybrid circuit. However, in a reflectarray application, the planar array configuration of the reflecting surface limits the available cell size. The use of the hybrid increases significantly the size of the circuit and practically limits its application to linear arrays.

In the third implementation of the present invention, the feeding source illuminates the reflectarray at a frequency $f_i$. The reflected wave frequency corresponds to a mixing product of $f_i$ with the one of the harmonics of the oscillating frequency $N*f_{os}$ of the SOM array. N is typically up to 3, as there is a trade-off between selecting a higher harmonic which allows for a larger phase tuning range, and being able to have mixing gain.

As in the previous proposed implementations of the reconfigurable reflectarray, an initial tuning is necessary in order to compensate for the different illuminating signal phases that arrive at the SOMs. This is done by controlling the length of the transmission line stubs from the antenna terminal to the active circuit nodes, as in the previous architectures.

Once the initial tuning or compensation has been introduced, the output phase variation of the SOM is obtained by varying the free-running frequency of each SOM by means of a control parameter (e.g., a varactor voltage).

In contrast to the previous two proposed topologies, in this third proposed architecture, there is no synchronization of the SOM cells with the feeding source. However, as noted, the SOMs are synchronized among them through a coupling network and with the use of an external reference signal at the circuit layer. This coupling is at $f_{os}$, so the stable output phase variation at the fundamental frequency $f_{os}$ is of 180°, and the stable output phase variation at higher harmonics $N*f_{os}$ corresponds to N*180°. In order to have a maximum output phase variation, the radiated frequency is chosen to be $Nf_{os}\pm f_i$, ($N\geq 1$) as the N*180° phase variation of the oscillating frequency at $N*f_{os}$ is directly transferred to the mixing product $Nf_{os}\pm f_i$.

An important point is that of the output filtering. In order not to radiate undesired mixing products it is necessary to introduce some filtering at the oscillation frequency $f_{os}$ and its harmonics $Nf_{os}$. The use of harmonic mixing with N>1 relaxes the filtering requirements.

These filtering requirements can be explained more easily using a numerical example:

Consider an X band application with the input signal at a frequency $f_i$=9 GHz, and the output signal frequency for example at $f_o$=11 GHz=$N*f_{LO}+-f_i$, where N is the order of the harmonic that is used for translating in frequency the input signal. Hence, by definition $f_{LO}=(f_o-+f_i)/N$. Selection of the sign depends on the design, in other words whether it is possible to achieve mixing gain, as well as other considerations such as linearity, system frequency planning.

If the first harmonic is used for the mixing, N=1: $f_{LO}$=20 GHz or $f_{LO}$=2 GHz.

In both cases it is easy to filter out the local oscillator signal as it is far from the antenna operating band.

If N=2, then $f_{LO}$=10 GHz or $f_{LO}$=1 GHz. In this case if one selects $f_{LO}$=10 GHz the local oscillator signal falls in the antenna bandwidth and would be radiated. As a result due to electromagnetic interference filtering the LO maybe required. It should be noted that $f_{LO}$=10 GHz is used in retro-directive array applications.

If N=3, then $f_{LO}$=6.66 GHz or $f_{LO}$=0.66 GHz. In a similar manner, selecting $f_{LO}$=6.66 GHz may require some filtering at the antenna ports, however in this case filtering is much easier than in the case of N=2, as $f_{LO}$ falls outside the operating band.

In summary, depending on the local oscillator harmonic and the mixing product that is used in the frequency planning of the architecture, it might be necessary to filter out the local oscillator signal or unwanted sidebands to avoid unwanted radiation. This is more pronounced if the second harmonic is used for the mixing, as in this case the local oscillator frequency may fall in the antenna bandwidth.

The radiating elements (antennas) must accommodate both input $f_i$ and output $N*f_{os}\pm f_i$ frequencies, which may require a broadband or dual band design. The radiating elements can be aperture coupled patch antennas. If isolation among the input and output is desired, two ports at orthogonal polarizations maybe used. Depending on the spacing between the input and output frequencies, the designer may choose to implement a broadband antenna or a dual band antenna design.

This third implementation of the invention has, in turn, two options of configurations:

A first option is that the input and output of the SOMs are at the same node, connected to the antenna terminal. In case that a FET based SOM, for example, is used, the drain node terminal maybe used for both input and output signals. This architecture simplifies the circuit, as only one antenna terminal (port) is required. However, with this configuration it is generally more difficult to achieve mixing gain, although it is possible ["A reflection mode self-oscillating GaAs FET mixer," C. W. Pobanz and T. Itoh, Proceedings of the 1994 Asia Pacific Microwave Conference (APMC 1994), pp. 131-134, 1994]. In addition, the array re-radiates any reflected input signal. It is possible to filter out the reflected signal by utilizing some hybrid approach ["Retro-directive arrays for wireless communications," R. Y. Miyamoto, and T. Itoh, IEEE Microwave Magazine, vol. 3, no. 1, pp. 71-79, March 2002], though this increases significantly the circuit complexity and may not satisfy the available size limitations.

In a second option for the implementation of the invention with SOMS, the input and output of the SOMs are at different nodes, connected to two different antenna terminals. This way, it is easier to achieve mixing gain. For example, if a FET based SOM is used, the gate terminal can be used as the input and the drain as the output. In this case one may use different polarizations for the input and output in order to separate the input and output signals and avoid unwanted radiation.

The first configuration (one single port) is more compact, but the second configuration (with different input and output ports) allows for more design freedom leading to a potentially better performance, as it is easier to obtain gain, and also it is easier to filter unwanted mixing products.

Some benefits of the present invention can be summarised as follows:

The proposed implementations allow for electronic control of the beam. This reduces the setting time of the reconfigurable reflectarray system in comparison with the use of mechanical control.

The active circuit of the reconfigurable reflectarray is an autonomous circuit, whose design depending on the specific embodiment, uses an oscillator, a push-push oscillator or a self-oscillating mixer. The passive radiating circuit of the reflectarray is designed to have the necessary resonances for each implementation.

The autonomous elements are synchronized in frequency with each other forming a dynamical system. The synchronization properties of autonomous circuits are exploited to change the phase of the reflected wave form each element.

The achievable output phase variation is of 180° when using the oscillator circuit, up to 360° when using push-push oscillators and N*180° (N≥2) when using self-oscillating mixers, and in any of these three implementation the output phase variation is achieved by using electronic means.

In the second implementation, radiating the second harmonic component allows obtaining a continuous stable output phase variation of up to 360° leading to an increase in the beam scanning angle of these systems. The input modulated signal that injection locks the oscillator elements is at the fundamental frequency (first harmonic). The second harmonic component of the oscillator is then radiated from the antenna through its second resonance. As the oscillator is injection locked at its fundamental frequency, radiation of the second harmonic allows one to control the phase of the radiated signal over 360° stable range.

In the third implementation, radiating a mixing product that contains harmonics of the oscillation frequency as $N*f_{os}\pm f_i$ allow stable output phase variations up to N*180° which lead to extended scanning ranges.

In contrast to traditional reflectarray configurations, the radiated power of an oscillator AIA based reflectarray depends weakly on the source signal power. The radiated power is determined by the oscillator AIA cell harmonic content, which can be maximized. This applies to the three implementations.

In the first implementation the first harmonic power is maximized. In the second implementation the second harmonic power is maximized. Moreover, unwanted radiation of the fundamental oscillator signal is minimized (the output power variation versus the reflected signal phase and injection power can be minimized), since the push-push architecture cancels odd harmonics at the output port. In the self-oscillating mixer implementation the radiated mixing product ($N*f_{os}\pm f_i$) is maximized. The harmonic components $N*f_{os}$ are filtered in the output to avoid unwanted radiation.

In the three proposed implementations, compact layout of the oscillator or self-oscillating mixer circuit allows its size to be limited to the cell antenna surface, thus not restricting the array element spacing.

The proposed implementations allow both to perform beam steering and beam-shaping of the radiated signal. In the two first implementations, when synchronized, each oscillator establishes a fixed phase relationship with the feeding (illuminating) source and with the nearest neighbour cells and because every oscillator can be independently controlled by the corresponding phase shifting device that changes the free-running frequency of oscillation, a desired phase distribution between the cells of the array can be defined.

This concept also applies to the third implementation, although now the fixed phase relationship is established with the external injection source at the circuit layer through the coupling network that couples all the array elements. Once the complete system is synchronized the output phase distribution at $f_{os}$ and consequently at $N*f_{os}\pm f_i$ can be modified by independently varying the free-running frequency of the self-oscillating mixers using a phase shifting device.

The industrial use of the described invention is directly related to the number of applications reflectarrays find nowadays. Among the possible applications for reflectarrays in this field, earth observation or orbital debris radar can be highlighted. The proposed reflectarray antenna system and method can be implemented both on low earth orbit (LEO) satellites and on geosynchronous orbit (GEO) satellite systems. Also reflectarrays have a natural application in failure recovery situations where a spare antenna can be reconfigured to substitute another one that is malfunctioning. Reconfigurable reflectarrays are also considered for their use in ground satellite terminals and they have also been proposed for Local Multipoint Distribution Network (LMDS).

In the first and second implementations proposed, constant envelope modulation schemes are preferred as the oscillator dynamics eliminate amplitude variations. Modulation formats with constant envelope, such as constant phase modulation (CPM), examples of which are minimum shift keying (MSK), Gaussian minimum shift keying (GMSK), and continuous phase frequency shift keying (CPFSK) can be directly used in the proposed system and method. One example of a satellite system that uses MSK and GMSK modulation and which this invention is applicable to is the SATMODE system funded principally by the European Space Agency (ESA).

BRIEF DESCRIPTION OF THE DRAWINGS

To complete the description and in order to provide for a better understanding of the invention, a set of drawings is provided. Said drawings form an integral part of the description and illustrate a preferred embodiment of the invention, which should not be interpreted as restricting the scope of the invention, but just as an example of how the invention can be embodied. The drawings comprise the following figures.

DETAILED DESCRIPTION OF THE INVENTION

Here below some practical implementations of a reflectarray in accordance to different embodiments of the invention are described.

Figure 1:
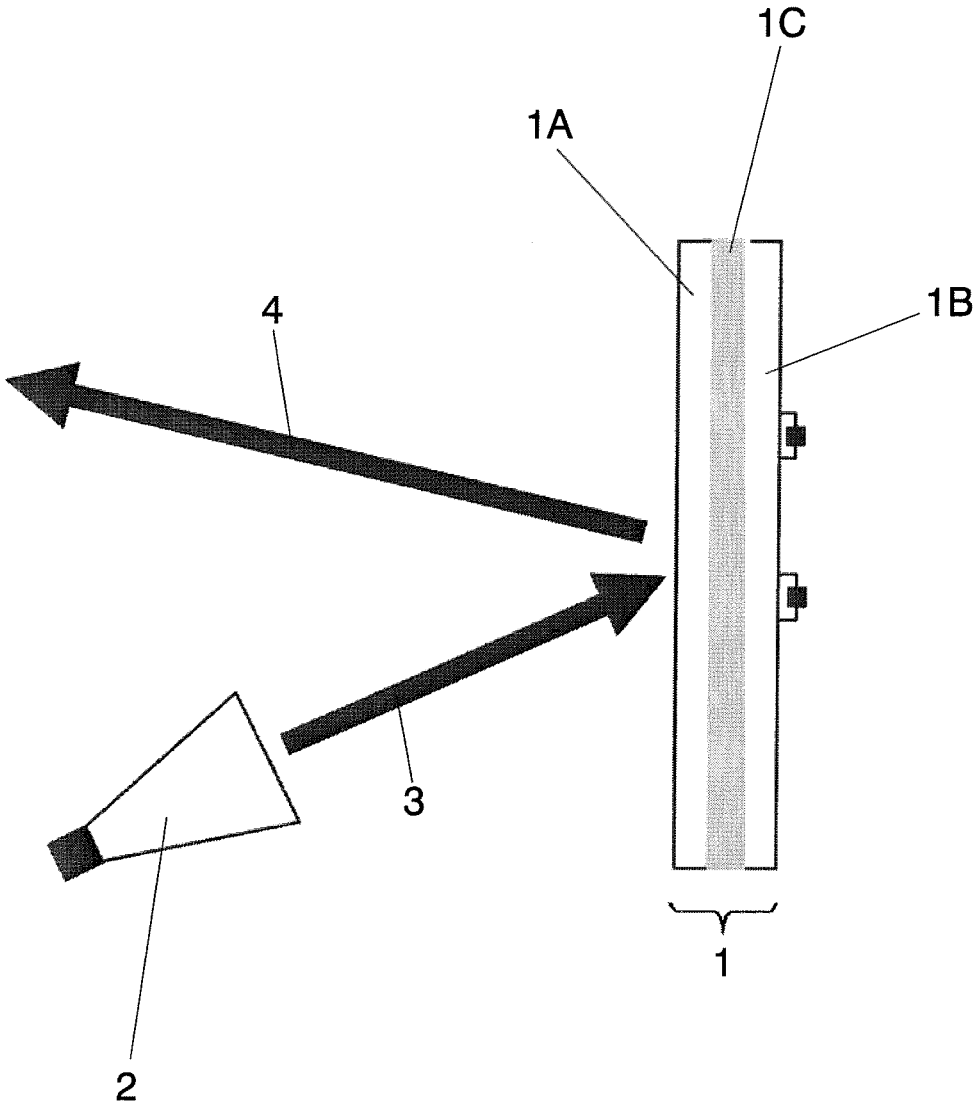
FIG. 1 shows a schematic lateral view of a reflectarray fed in a star coupling network, according to a preferred embodiment of the invention.

The reflectarray comprises a plurality of cells integrated in a same substrate or PCB (1) and is externally illuminated by a feeding source (2) as shown in FIG. 1.

The reflectarray has an input signal (3), which is the illuminating signal at the illuminating or input frequency and an output signal (4) reflected by a reflective surface, being each array cell independently coupled to the feeding source (2) in a star coupling network topology and being each of the cells coupled to its nearest neighbours cells by means of a coupling network.

Each cell of the reflectarray is an active integrated antenna formed by a passive radiating element connected to an oscillator circuit. The passive radiating circuit is placed on the reflective surface forming a side (1A) of the reflectarray and the oscillator circuit is placed on the reverse side (1B) of said reflective surface. The Printed Circuit Board or PCB (1) can contain an intermediate dielectric layer (1C), typically foam, which is placed between the radiator and the oscillator circuit.

Figure 2:
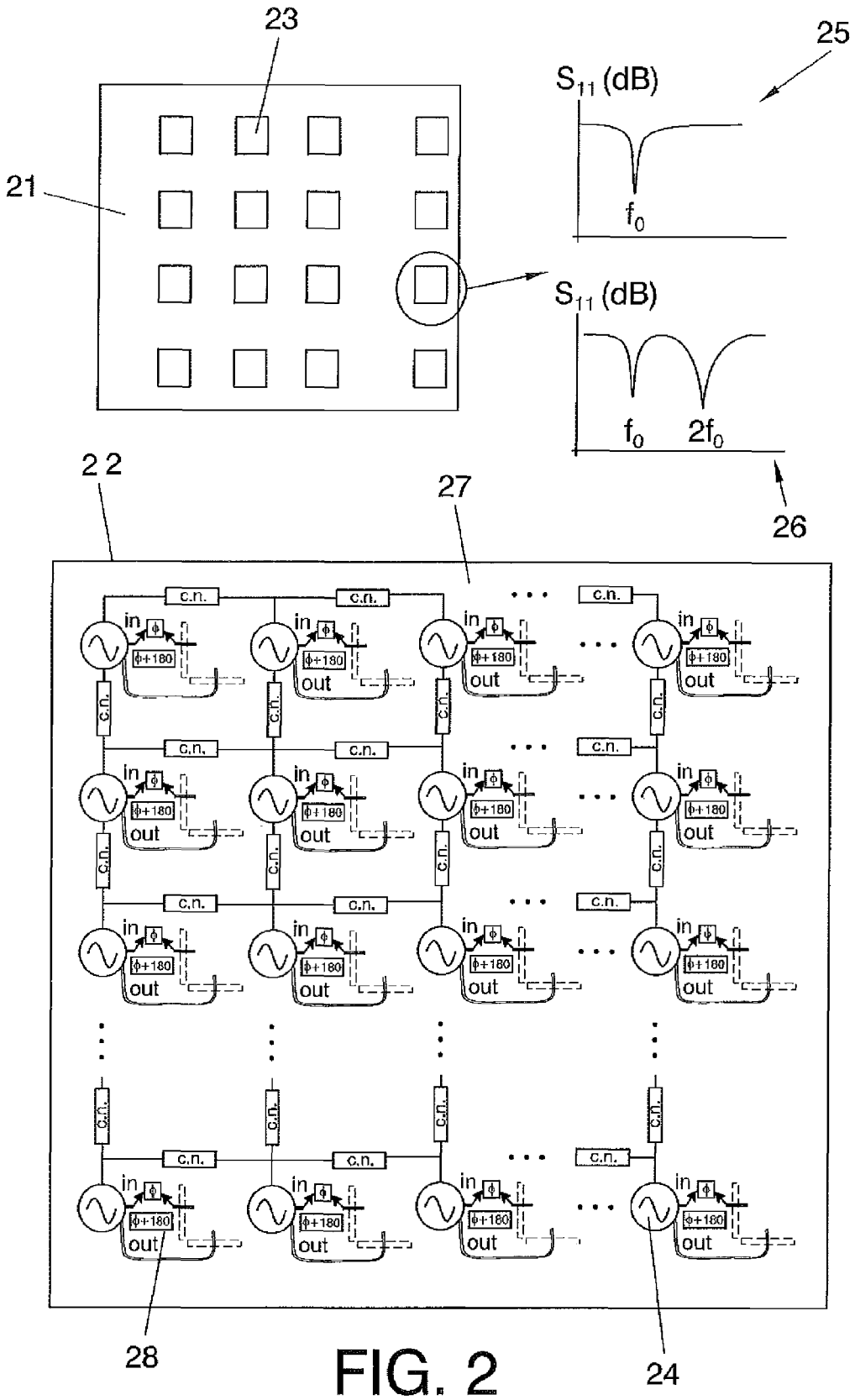
FIG. 2 shows the two sides of a reflectarray in accordance to a preferred embodiment of the invention based on oscillator AIAs.

FIG. 2 depicts a schematic representation of the first and second proposed implementations for reconfigurable reflectarrays, showing the two sides of the reflectarray: a first side (21) where the radiating elements (23) are placed on and a second side (22), reverse of the first side (21), where the oscillator elements (24) and the coupling networks (27) are located.

The oscillator elements (24) are push-push oscillators in the case of the second implementation. In the first implementation of the invention, the oscillator elements (24) forming the active circuit are common oscillators.

The radiating elements (23) forming the passive radiating circuit have a single resonance, at a fundamental frequency ($f_o$), in the first implementation of the reflectarray. In the second implementation, the passive radiating circuit has a double resonance at $f_o$ and $2f_o$.

In both the first and second implementations, the feeding source (2) is radiating at a fundamental frequency $f_i=f_0$. The oscillator elements (24) get synchronized to this incoming signal frequency $f_i=f_o$ and at the same time the oscillator elements get synchronized with their nearest neighbours oscillators by means of a coupling network (27). Once synchronized, a phase relationship is established between the illuminating signal and the output signal of the oscillators. This phase relationship is modified by varying the free-running frequency of the oscillator elements by means of a control parameter, e.g., voltage of a varactor diode. By doing this, the output phase at each oscillator can be varied.

In order to achieve the maximum output phase variation of 180°, a variable delay is introduced at the input port of the oscillators. Using a switching mechanism (28) it is possible to change the phase of the input signal arriving at the oscillators by 180°. Each combination of input phases lead to a different solution of the system. Using several of the existing solutions it is possible to cover the complete output phase range of 180°.

In the first and second implementations, there is an initial tuning of the output phase of the oscillators elements (24) in order to compensate for the phase imbalances due to the relative position of each element in the reflectarray with respect to the illuminating or feeding source (2). This tuning points the reflected beam in an initial direction. The tuning is done using stubs of different lengths ($L_{11}, \ldots, L_{NN}$) that are introduced between the antenna connection point and the output of the oscillator elements (24).

In the first implementation the oscillator elements (24) are oscillators with a free-running frequency around $f_o$. Thus, the radiated output signal of the reflectarray system, in this first implementation, is the first harmonic $f_o$ of the oscillator elements (24), as shown by the curve (25) of the S-parameter ($S_{11}$) indicating the input port reflection coefficient. Synchronizing at the first harmonic $f_o$ and radiating also at $f_o$ allows to obtain an output phase variation at each oscillator element of 180° by varying the control parameter, e.g., voltage of a varactor diode and combining several solutions.

In the first implementation the radiating elements (23) have a single resonance at $f_o$ that allows synchronizing at $f_o$ with the illuminating horn or feeding source (2) and, at the same time, radiating the first harmonic $f_o$ of the output signal from the oscillators elements (24), which are common oscillators with a free-running frequency around $f_o$.

In order not to affect the output signal phase, it is recommended to separate the input and output ports of the oscillator elements, so the radiating elements have to be designed accordingly. The variable delay is located at the input port to control the phase of the input signal.

In the second implementation of the invention, the radiated output signal is the second harmonic of the oscillator elements $2f_o$. Synchronizing with the first harmonic $f_i=f_o$ and radiating at the second harmonic $2f_o$ allows an output phase variation at each oscillator element of 360° by varying the control parameter, e.g., voltage of a varactor diode.

In this second implementation each of the oscillator elements (24) is a push-push oscillator. The push-push oscillator is formed by two oscillator elements that are coupled together by means of a coupling network. In its simplest form the coupling network consists of a 180° transmission line, but the size of such a line maybe prohibitive. Alternatively one may use a lumped element, potentially of meta-material type, phase-shifting network in order to minimize its size. The frequency of one of the oscillators of the pair has a fixed value while the frequency of the other oscillator of the pair is modified using a control parameter, e.g., voltage of a varactor diode. At the output node of the push-push oscillator elements (24), the first harmonic components at $f_o$ of the oscillator elements are cancelled while the second harmonic components at $2f_o$ add up, as shown by the other curve (26) of the S-parameter ($S_{11}$). Once the push-push oscillator is synchronized to the illuminating signal and to their nearest neighbours by mean of the coupling network, its output phase variation can be obtained by varying the value of the control parameter. The achievable output phase variation at the second harmonic component $2f_o$ of the push-push oscillator can be up to 360°.

In order to achieve the maximum output phase variation of 360°, a variable delay that allow selecting the input signal phase from the values $\phi$ and $\phi+180$ by means of a switching mechanism (28) is introduced at the input port. Using several combinations of input phases it is possible to achieve the maximum output phase range of 360°.

In this second implementation the radiating elements (23) have a double resonance at $f_o$ and at $2f_o$ that allows synchronizing with the feeding source (2) at $f_o$ and at the same time radiating the second harmonic $2f_o$ of the output signal from the oscillator elements (24).

As in the first implementation, in order not to affect the output signal phase, it is recommended to separate the input and output ports of the oscillator elements, so the radiating elements have to be designed accordingly.

Figure 3:
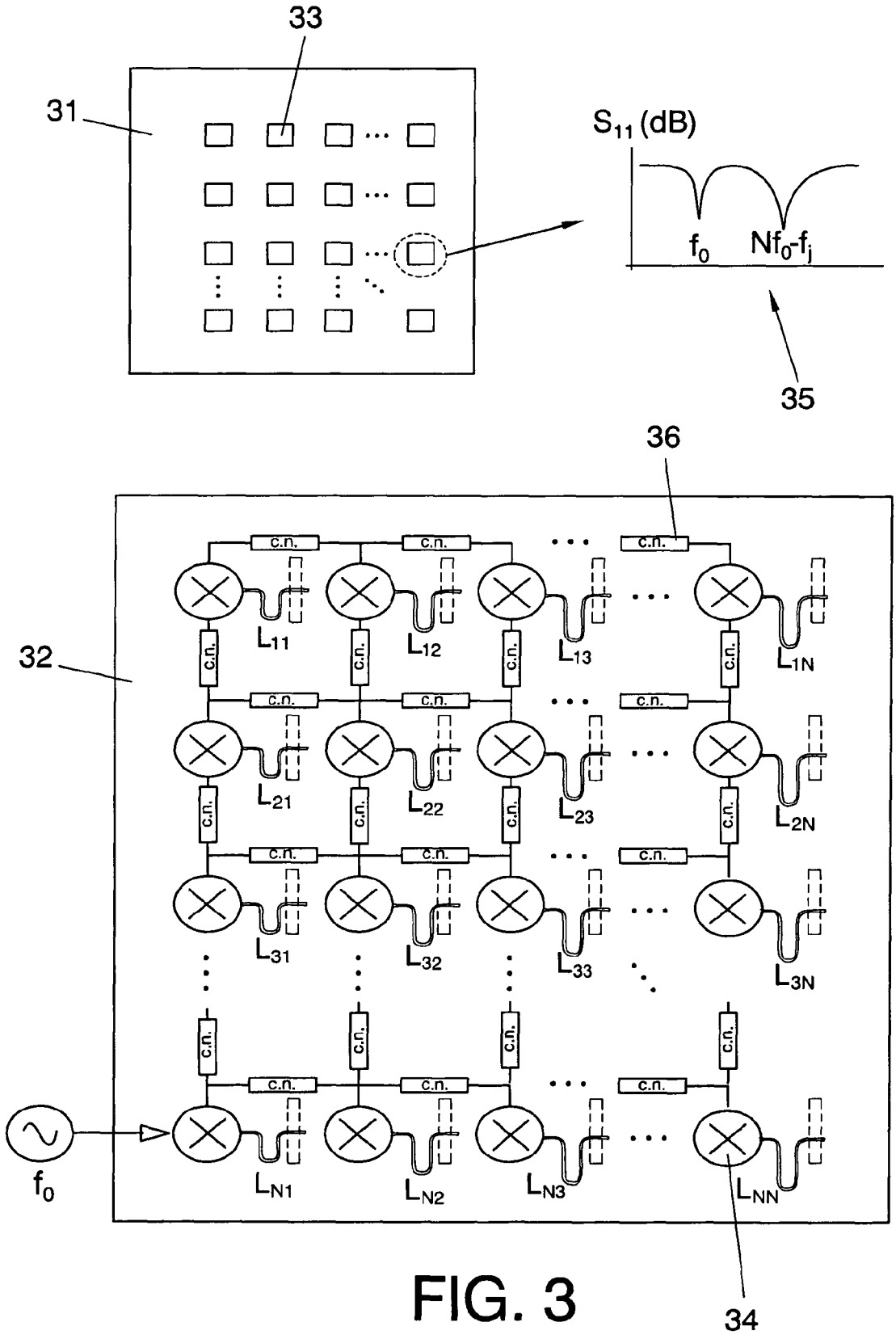
FIG. 3 shows the two sides of a reflectarray in accordance to another preferred embodiment of the invention based on self-oscillating mixer AIAs with a single input/output port.

FIG. 3 shows a schematic representation of the third proposed embodiment of the invention, using SOM AIAs and, in a first option of this implementation, both the input and output of the SOM are at the same node that is then connected to the antenna or radiating element (33). The radiating element (33) has a double resonance at $f_i$ and at $N*f_{osc}-f_i$, as shown by the curve (35) of the S-parameter ($S_{11}$).

FIG. 3 shows the two sides of the reflectarray in the third implementation when using a single port for both the input and the output.) The radiating elements (33) are placed on one side (31) with a double resonance and at the other side (32) the self-oscillating mixer (34) elements are located. Every self-oscillating mixer (34) has a conversion gain at the output mixing product $Nf_{osc}\pm f_i$.

In the third implementation of the invention, the feeding source (2) illuminates the reflectarray at a frequency $f_i=N*f_{osc}+\Delta f$. This incoming signal is mixed with the SOM fundamental frequency $f_{osc}$ or with one of the harmonics of the self-oscillating mixers (34). The output signal frequency is hence $f_o=Nf_{osc}\pm f_i$.

In the third implementation there is an initial tuning of the output phase of the self-oscillating mixers (34) in order to compensate for the phase imbalances due to the relative position of each element in the reflectarray with respect to the illuminating source. This tuning is done using stubs of different lengths ($L_{11}, \ldots, L_{NN}$) in the input/output ports of each self-oscillating mixer (34) element.

In the third implementation the self-oscillating mixers are nearest neighbour coupled by mean of a coupling network (36) at the self-oscillating mixer -SOM-fundamental frequency $f_{osc}$. This coupling allows synchronization at a frequency $f_{osc}$ between the self-oscillating mixers in the system. Once the self-oscillating mixers are synchronized, the phase of the output signal at $Nf_{osc}\pm f_i$ can vary in a range of N360° by modifying the value of the control parameter, e.g., voltage of a varactor diode.

In the third implementation the radiating elements (33) have a double resonance at $f_i$ and at $Nf_{osc}\pm f_i$ that allow synchronizing with the feeeding source (2) at $f_i$ and at the same time radiating at $Nf_{osc}\pm f_i$.

The oscillator or active elements are self-oscillating mixers (34) with a free-running frequency $f_o$. The self-oscillating mixers have conversion gain at the frequency of the radiated mixing product.

Figure 4:
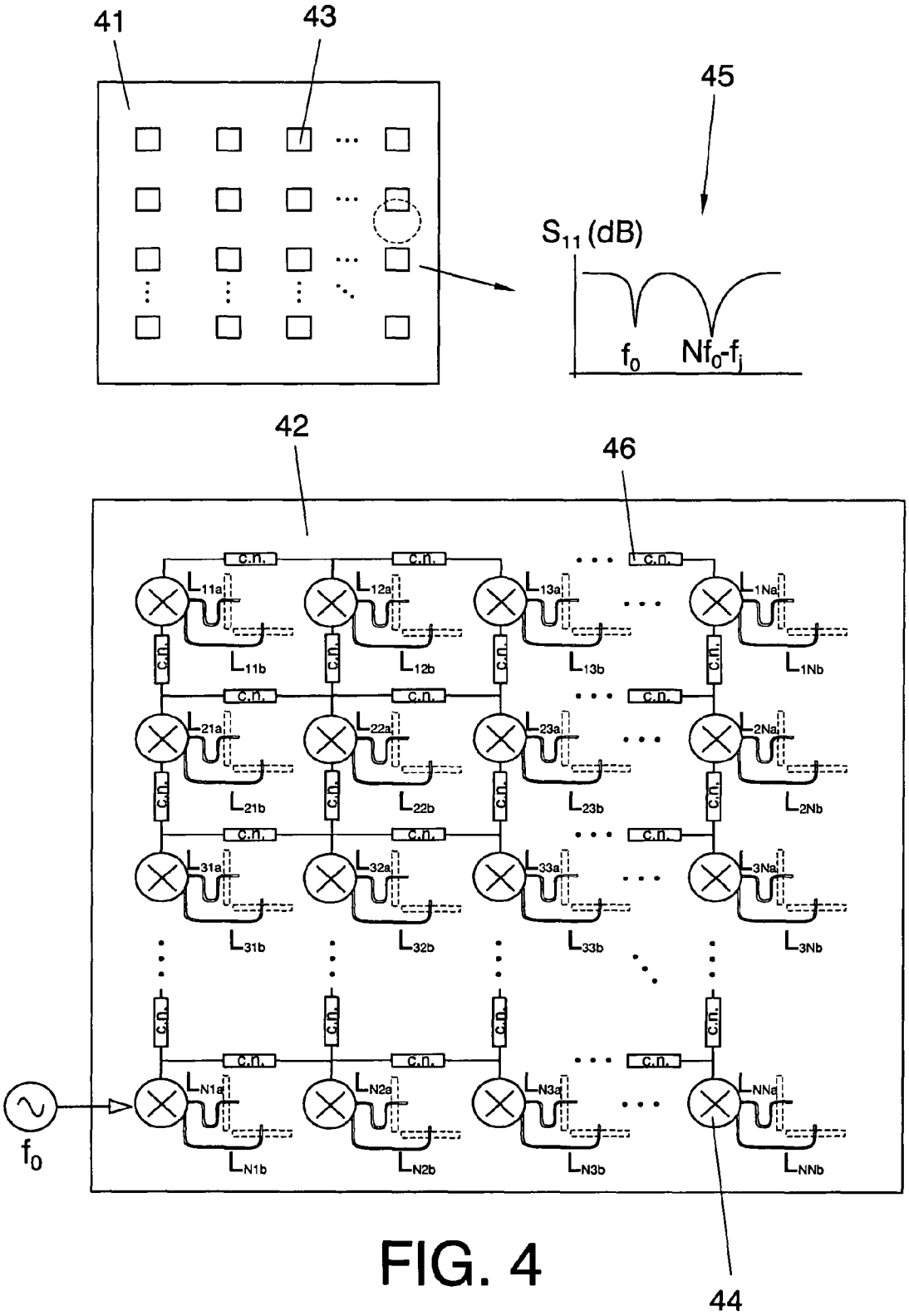
FIG. 4 shows the two sides of a reflectarray in accordance to another further preferred embodiment of the invention based on self-oscillating mixer AIAs with two different ports for the input and the output.

FIG. 4 shows a schematic representation of the third proposed embodiment of the invention, using SOM AIAs and, in a second option of this implementation, where the input and output of the SOM are at different nodes and connected to two different antenna terminals with orthogonal polarizations.

FIG. 4 shows the two sides of the reflectarray in the third implementation when using two different ports with orthogonal polarizations for the input and the output of the system. On side one (41) of the reflectarray there are radiating elements (43) with a double resonance and on the reverse side (42) the self-oscillating mixer elements (44) and the coupling networks (46) are located are placed. The radiating element (43) has a double resonance at $f_i$ and at $N*f_{osc}-f_i$, as shown by the curve (45) of the S-parameter ($S_{11}$). The initial tuning is done using stubs of different lengths ($L_{11a}, \ldots, L_{NNa}$) in the input ports of each self-oscillating mixer element (44) and using respective stubs of different lengths ($L_{11b}, \ldots, L_{NNb}$) in the output ports.

Figure 5:
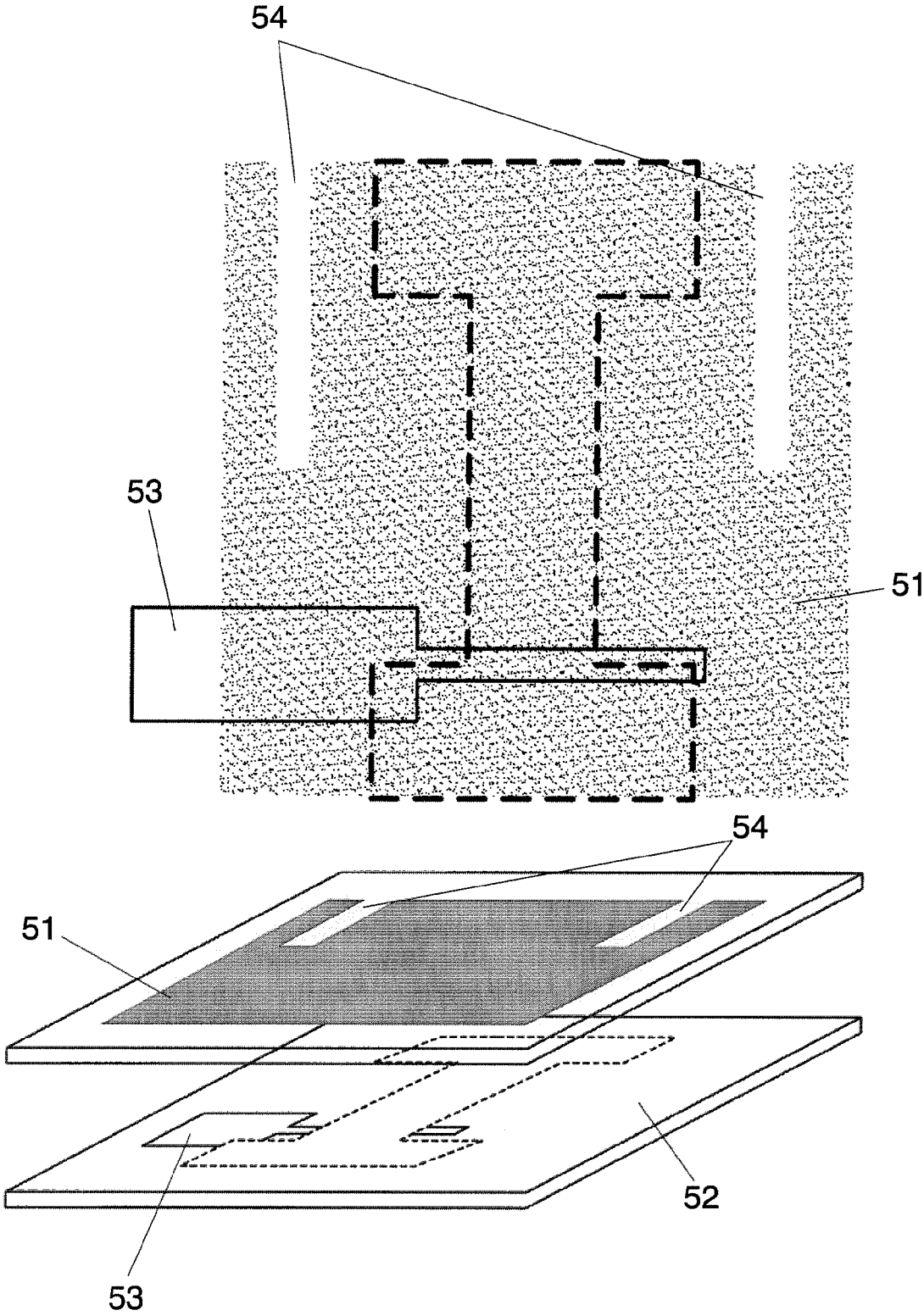
FIG. 5 shows a configuration of the radiating elements for a possible embodiment of the invention as represented in FIG. 2.
Figure 6:
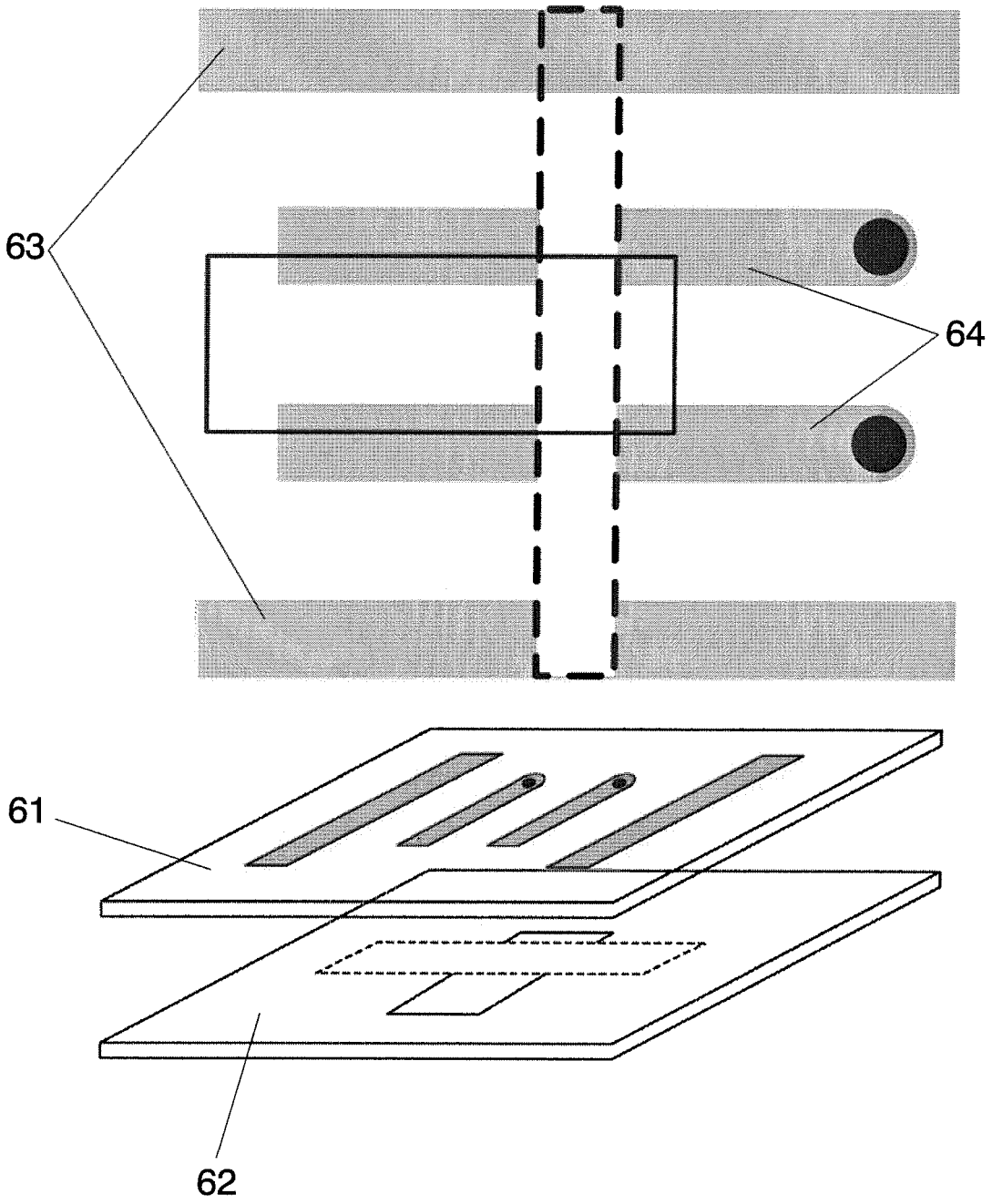
FIG. 6 shows another configuration of the radiating elements for a possible embodiment of the invention as represented in FIG. 2.

FIGS. 5 and 6 shows two possible designs or alternative configurations of the passive radiating circuit for second implementation of the invention shown in FIG. 2, in which the radiating elements (23) present a double resonance at $f_o$ and $2f_o$.

A first alternative of implementing said radiating elements (23), shown in FIG. 5, consists of a patch antenna (51) coupled to the oscillator circuitry (52) using an offset fed slot (53). The coupling offset fed slot (53) allows one to place the oscillator circuitry (52) and patch antenna (51) in separate layers. A dual resonance is achieved by offsetting the feed of the slot (53) towards its edge. A patch radiator or antenna (51) is used to increase the forward gain and improve the front-to-back ratio of the antenna. The patch size is also used to increase the resonance bandwidth at $2f_o$. Slits (54) are introduced to the patch to adjust the resonance at $f_o$ while reducing its overall size to fit within a square of $\lambda_o/4$ side length.

A second alternative of implementing said radiating elements (23), shown in FIG. 6, uses aperture coupled parallel resonators (61) for coupling to the oscillator circuitry (62). Two half-wavelength dipoles (63) provide the resonance at $2f_o$ and two quarter wavelength monopoles (64) provide the resonance at $f_o$. In order to avoid the use of shorting pins while maintaining a compact size, a single half-wavelength but wide dipole resonating at $f_o$, instead of the two monopoles, can be used too.

In the first and second implementations, constant envelope modulation is preferred, as oscillators tend to eliminate amplitude variations, which would introduce spectral re-growth to a signal with varying envelope. The first and second implementations are preferable for transmitting applications.

The third implementation does not have limitations in terms of modulation and is preferable for receiving applications, and also can be used both for transmitting and receiving applications.

In this text, the term "comprises" and its derivations (such as "comprising", etc.) should not be understood in an excluding sense, that is, these terms should not be interpreted as excluding the possibility that what is described and defined may include further elements, steps, etc.

The invention is obviously not limited to the specific embodiments described herein, but also encompasses any variations that may be considered by any person skilled in the art (for example, as regards the choice of components, configuration, etc.), within the general scope of the invention as defined in the appended claims.

Some preferred embodiments of the invention are described in the dependent claims which are included next.

The invention claimed is:

1. Reflectarray antenna system comprising:

a plurality of cells, each cell being an active integrated antenna, which is formed by a passive radiating circuit connected to an active circuit, the passive radiating circuit being illuminated by a feeding source which radiates at an input frequency $f_i$, the active circuit comprising an oscillating element with an oscillation frequency $f_{osc}$, and all the oscillating elements from every cell of the reflectarray being synchronized among them and producing an output signal with a frequency related to the input frequency $f_i$ of an input signal and the oscillation frequency $f_{osc}$ by an output phase variation, the reflectarray antenna system further comprising a varactor diode which varies the oscillation frequency $f_{osc}$ for setting the output phase variation.

2. Reflectarray antenna system according to claim 1, wherein the oscillating element is an oscillator oscillating at a fundamental frequency $f_o=f_{osc}$ and all the oscillators are externally synchronized by the feeding source, and coupled among them by a resistively loaded transmission line at the fundamental frequency $f_o=f_i$.

3. Reflectarray antenna systems according to claim 2 wherein the phase of the input signal arriving to each of the oscillators is controlled by a delay line at an input port of the oscillators, having the delay line two different delays which differ 180°.

4. Reflectarray antenna system according to claim 3, wherein the frequency of the output signal from the system is the fundamental frequency $f_o$ of the oscillators.

5. Reflectarray antenna system according to claim 4, wherein the varactor diode set the output phase variation at the fundamental frequency $f_o$ in an interval of 180° by selecting the delay of the delay line at the input port of each oscillator.

6. Reflectarray antenna system according to claim 1, wherein the oscillating element is a push-push oscillator circuit oscillating at a fundamental frequency $f_o=f_{osc}$ and all the push-push oscillators are externally synchronized by the feeding source and coupled among them by the resistively loaded transmission line at the fundamental frequency $f_o=f_i$.

7. Reflectarray antenna system according to claim 6, wherein the frequency of the output signal from the system is twice the fundamental frequency $f_o$.

8. Reflectarray antenna system according to claim 7 wherein the phase of the input signal arriving to each of the oscillator elements is controlled by selecting a delay line from two different delay lines at an input port of the push-push oscillator circuit.

9. Reflectarray antenna system according to claim 8, wherein the varactor diode set the output phase variation at the fundamental frequency $f_o$ in an interval of 360° by selecting the delay line at the input port of each push-push oscillator circuit.

10. Reflectarray antenna system according to claim 1, wherein the oscillating element is a self-oscillating mixer with a fundamental frequency $f_{osc}$ and all the self-oscillating mixers are illuminated by the feeding source at the input frequency $f_i$ mixed with one of the harmonic components $N*f_{osc}$, being $N\geq 2$, of the fundamental frequency $f_{osc}$ of the self-oscillating mixer.

11. Reflectarray antenna system according to claim 10, wherein the frequency of the output signal from the system is $N*f_{osc}\pm f_i$.

12. Reflectarray antenna system according to claim 1, wherein the self-oscillating mixer is nearest neighbour coupled by the resistively loaded transmission line at the fundamental frequency $f_{osc}$.

13. Reflectarray antenna system according to claim 1, further comprising a phase compensating transmission line between a connection point to the passive radiating circuit and an output point of the active circuit.

14. Reflectarray antenna system according to claim 13, wherein the transmission line has a length for compensating phase imbalances among the different active elements due to their relative position with respect to the feeding source.

* * * * *